US006102517A

United States Patent [19]

Kobayashi et al.

[11] Patent Number: 6,102,517

[45] Date of Patent: Aug. 15, 2000

[54] INK-JET RECORDING APPARATUS FOR INK CARTRIDGE

[75] Inventors: Takao Kobayashi; Munehide Kanaya; Minoru Usui; Shoichi Hiraide; Kazuo Koshino, all of Nagano, Japan

[73] Assignee: Seiko Epson Corporation, Tokyo, Japan

[21] Appl. No.: 08/894,669

[22] PCT Filed: Dec. 25, 1996

[86] PCT No.: PCT/JP96/03781

§ 371 Date: Mar. 11, 1998

§ 102(e) Date: Mar. 11, 1998

[87] PCT Pub. No.: WO97/23352

PCT Pub. Date: Jul. 3, 1997

[30] Foreign Application Priority Data

| | | | |
|---|---|---|---|
| Dec. 25, 1995 | [JP] | Japan | 7-350063 |
| Dec. 25, 1995 | [JP] | Japan | 7-350064 |
| Feb. 23, 1996 | [JP] | Japan | 8-062173 |
| May 18, 1996 | [JP] | Japan | 8-148367 |

[51] Int. Cl.[7] ..... B41J 2/165

[52] U.S. Cl. ..... 347/23; 347/30

[58] Field of Search ..... 347/22, 23, 30

[56] References Cited

U.S. PATENT DOCUMENTS

| | | | |
|---|---|---|---|
| 5,543,826 | 8/1996 | Kuronuma et al. | 347/23 |
| 5,606,353 | 2/1997 | Mochizuki et al. | 347/23 |
| 5,627,572 | 5/1997 | Harrington, III et al. | 347/23 |
| 5,745,134 | 4/1998 | Hirabayashi et al. | 347/23 X |
| 5,831,646 | 11/1998 | Kuronuma et al. | 347/30 |
| 5,900,889 | 5/1999 | Tsukuda | 347/23 |
| 5,914,733 | 6/1999 | Sato et al. | 347/23 |

FOREIGN PATENT DOCUMENTS

| | | |
|---|---|---|
| 3-227650 | 10/1991 | Japan . |
| 4-371965 | 12/1992 | Japan . |
| 6-155758 | 6/1994 | Japan . |
| 7-144419 | 6/1995 | Japan . |
| 7-148918 | 6/1995 | Japan . |
| 7-323645 | 12/1995 | Japan . |

*Primary Examiner*—William J. Royer
*Attorney, Agent, or Firm*—Stroock & Stroock & Lavan LLP

[57] ABSTRACT

An ink jet printing apparatus has an ink jet print head mounted on a carriage reciprocally movable relative to a print medium, an ink cartridge for supplying ink to the ink jet print head, a print control apparatus for outputting a drive signal to the ink jet print head in accordance with print data, flushing control apparatus for discharging ink, not contributing to print, in order to secure a normal ink discharge from the ink jet print head, and a control data storing apparatus for storing control data for the flushing control apparatus. A control mode of either of the print control apparatus and the head maintenance control apparatus may be altered by data from an ink characteristic data storing apparatus, provided on the ink cartridge, for storing control data based on the nature of ink.

22 Claims, 11 Drawing Sheets

INK-JET RECORDING APPARATUS FOR INK CARTRIDGE

FIELD OF THE INVENTION

The present invention relates to a printing apparatus which receives ink from an exchangeable ink cartridge and prints characters and the like on a print media while jetting ink droplets through nozzle orifices thereof.

BACKGROUND OF THE INVENTION

For example, an ink jet printing apparatus comprises a print head and an ink cartridge for containing ink therein. In the print head, a drive signal is applied to piezoelectric elements, heating elements or the like. Ink is pressurized by energy generated by those elements, and caused to be jet out in the form of ink droplets through nozzle orifices.

A print quality is determined by a resolution of the print head, and depends largely on viscosity of ink and a spread of ink in the print medium. For this reason, study and development are made for the improvements of ink characteristic, print head driving method adaptable to the characteristics of like ink, and maintenance conditions of purging periods in purging ink for preventing the clogging of the print head, the purging of ink from the print head being capped, and the like.

A remarkable improvement of the print quality of the printing apparatus is achieved when the ink characteristic and the print head driving method are both improved in harmony with each other. Manufacturers can incorporate such technical results of the development into the products. When a situation arises where altered control data must be loaded into the printing apparatus after delivered to the market, it is necessary to return the printing apparatus to its factory and replace an old storing means with a storing means storing the altered control data. This is almost impossible when considering the cost and labor to effect such work.

Accordingly, an object of the present invention is to provide a novel ink jet printing apparatus which can easily and automatically alter the print head driving method and the maintenance condition for removing the clogging of the print head in accordance with a change of the specification of ink, and an ink cartridge in use with the ink jet printing apparatus.

Ink as a chemical product is contained in the ink cartridge. Even if the ink cartridge run out of ink, there is a chance that ink is left in the ink cartridge. Therefore, ink per se as a chemical product and noncorrosiveness of high polymer material of the ink cartridge will contaminate environments. To avoid this, it is desirable to collect ink cartridges that run out have ink of, and refill the used ink cartridges with new ink and use the regenerated ones again. However, the regenerated products are somewhat degraded in reliability performance. For this reason, it is necessary to secure a satisfactory print quality, to consider an adverse affect on the print head, and to announce that the product is a regenerated one.

A second object of the present invention is to provide a novel ink jet printing apparatus which can secure a reliable print quality and satisfactory functionality of a regenerated ink cartridge, and an ink cartridge in use with the ink jet printing apparatus.

SUMMARY OF THE INVENTION

According to the present invention, there is provided an ink jet printing apparatus comprising: an ink jet print head mounted on a carriage reciprocatively moved relative to a print medium; an ink cartridge for supplying ink to the ink jet print head; print control means for outputting a drive signal to the ink jet print head in accordance with print data; head maintenance control means for discharging ink not contributing to print so as to secure a normal ink discharge from the ink jet print head; control data storing means for storing control data for the print control means and the head maintenance control means; and ink characteristic data storing means for storing ink characteristic data based on a nature of ink, and being disposed on the ink cartridge; wherein a control mode of either of the print control means and the head maintenance control means may be altered by the ink characteristic data.

With such a construction, the control conditions for the ink jet printing apparatus can be altered, without any aid of users, in compliance with the characteristic of ink in the ink cartridge and a reliability deteriorative variation ensuing from the reuse of the ink cartridge. Therefore, the operation mode of the ink jet printing apparatus may be altered in accordance with the composition of ink, which will greatly influences the print quality and the maintenance condition. When the used ink cartridge is used, the maintenance condition may automatically be altered in accordance with the number of the reuses of the ink cartridge.

DETAILED DESCRIPTION OF THE PREFERRED EMBODIMENTS

An embodiment of the present invention will be described with reference to the accompanying drawings.

Figure 1:
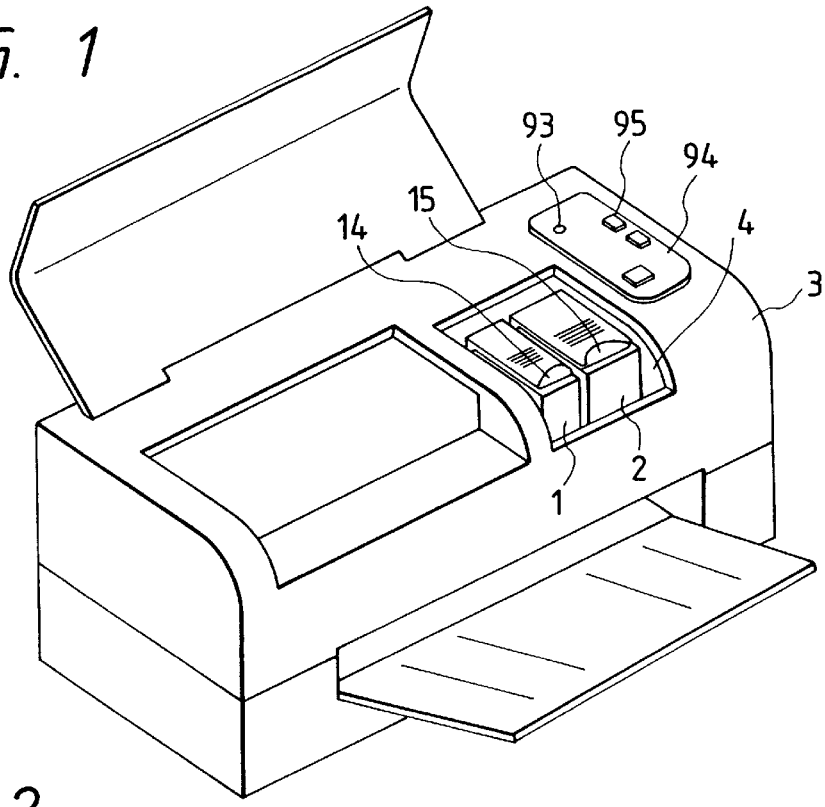
FIGS. 1 is a view showing an overall construction in an ink jet printing apparatus embodying the present invention.
Figure 2:
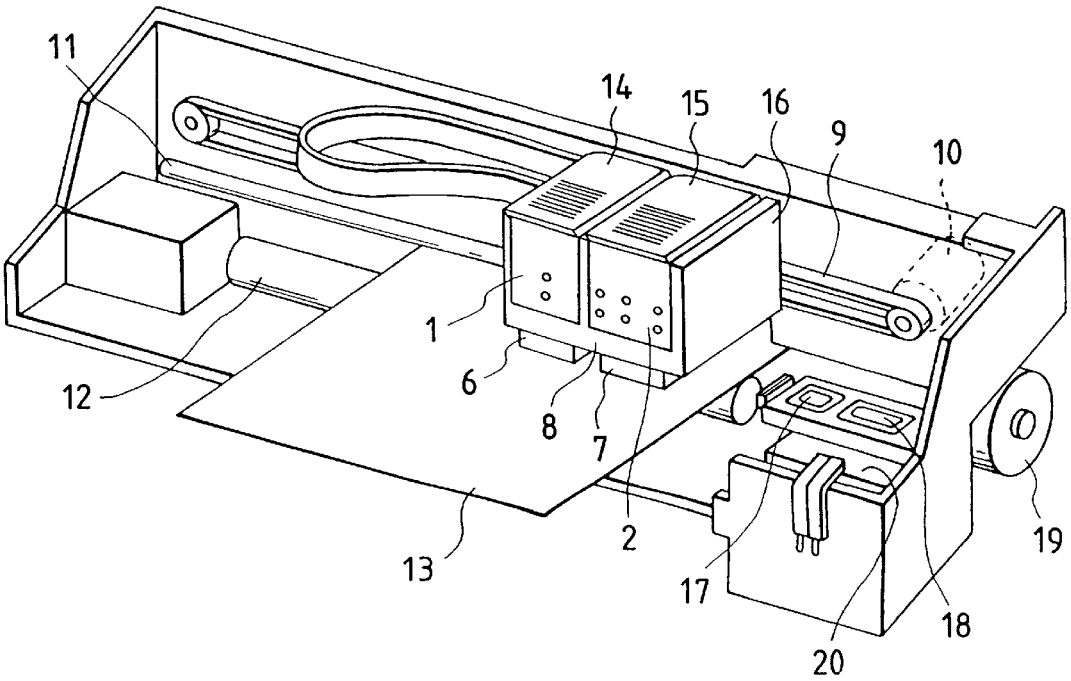
FIG. 2 is a view showing a printing mechanism in an ink jet printing apparatus embodying the present invention.

FIGS. 1 and 2 are views showing an overall construction and a printing mechanism in an ink jet printing apparatus embodying the present invention. In the figures, reference numerals 1 and 2 are a black ink cartridge and a color ink cartridge. These cartridges are attached to and detached from a carriage 8, which carries thereon black print head 6 and a color print head 7, by inserting the cartridges through a window 4 formed in a case 3.

As is well known, the print heads 6 and 7 have each a plurality of reservoirs for receiving ink from the ink cartridge, and a plurality of pressure generating chambers communicatively coupled with nozzle orifices for jetting ink droplets. A pressure applying means operates in response to a drive signal and pressurizes the pressure generating chamber associated therewith. In turn, the pressure generating chamber causes ink to jet out in the form of an ink droplet through the nozzle orifice associated therewith. In preparation for the next jetting of ink droplet, ink is supplied to the pressure generating chamber.

In a specific form of the pressure applying means of the pressure generating chamber, a diaphragm is used which is formed of an elastic plate-like member, which forms a part of the pressure generating chamber. The diaphragm is elastically deformed by a piezoelectric element. In another specific form of the pressure applying means, a heating element is used, which is energized by a drive signal applied thereto to heat and evaporate ink in the pressure generating chamber.

The carriage 8, coupled with a motor 10 by means of a timing belt 9, is moved parallel to a platen 12 while being guided by a guide member 11. The print heads 6 and 7 are mounted on the surface of the carriage 8, which faces a print sheet 13. A holder 16 with levers 14 and 15, which assist the attaching/detaching of the ink cartridges 1 and 2, is provided on the upper surface of the carriage 8.

Numerals 17 and 18 are capping members for sealing the black print heads 6 and 7. The capping members are coupled with a pump unit 20 for receiving a power from a paper feed motor 19. In a print rest period, the capping members 17 and 18 seal the surfaces of the nozzle apertures of the print heads 6 and 7 to prevent ink at the nozzle apertures from being dried. When the nozzle orifices are clogged, the capping members 17 and 18 seal the nozzle orifice surfaces of the print heads 6 and 7, and in this state, a negative pressure is applied to the print heads 6 and 7 from the pump unit 20, whereby ink is forcibly discharged or purged from the print heads.

Figure 3A:
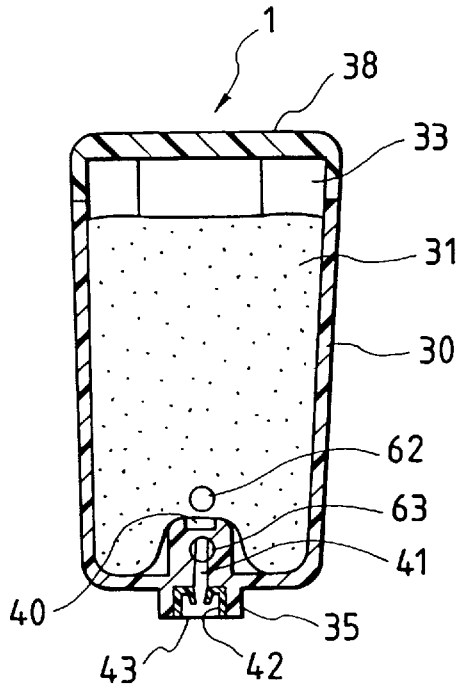
FIGS. 3(*a*) and 3(*b*) are views showing a black ink cartridge used in the ink jet printing apparatus.
Figure 3B:
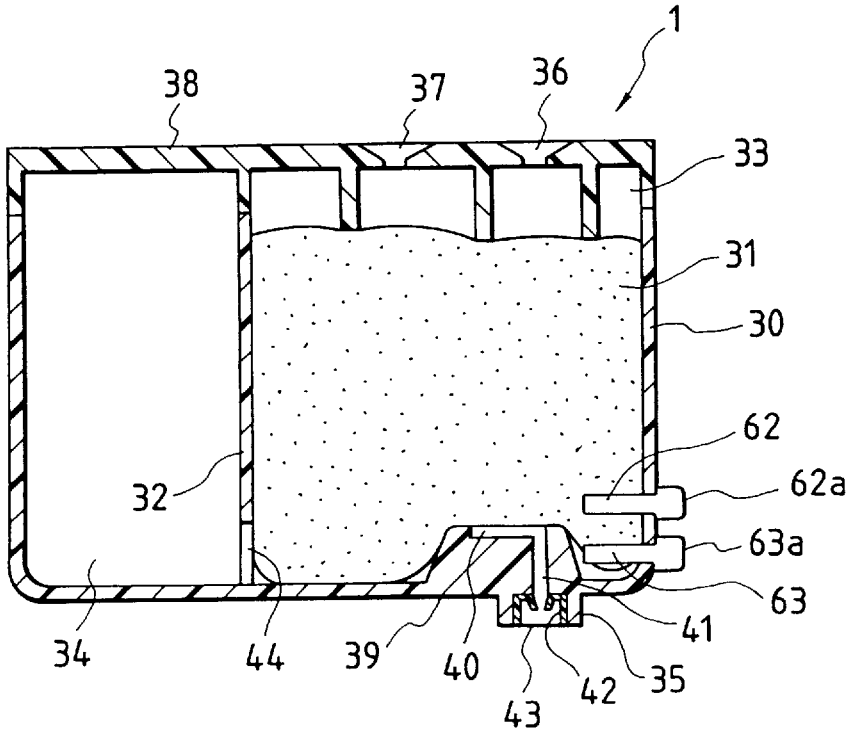

FIGS. 3(*a*) and 3(*b*) are views showing a specific example of a black ink cartridge. In the figure, numeral 30 is a substantially cuboidal container with an open end, the widthwise length of the container gradually increasing toward its open end. To secure an easy joining of the container to other members by thermal welding, the container is formed by injection molding polymer, such as polypropylene, polyethylene, polystyrene or the like. The container 30 has a room for containing a porous body 31 made of elastic material suitable for absorbing at least ink. In the present embodiment, the container is divided, by a partitioning plate 32, into a foam room 33 and an ink room 34 for directly containing ink.

An ink supply port 35 that will receive an ink supply needle of the black print head 6 is formed in the lower end of the foam room 33. The open end of the container 30 is sealingly closed by a cover 38 having an ink injection port 36 and an air communication port 37, which are slightly spaced from each other. The ink injection port 36 of the cover 38 is located closer to the ink supply port 35 of the foam room 33 when horizontally viewed.

A protruded part 39 is formed on the bottom of the foam room 33. The protruded part 39 cooperates with the cover 38 to compress the porous body 31. An ink inflow port 40 is formed in the upper end of the protruded part 39. A port passage 41 is extended from the ink inflow port 40 to the ink supply port 35. A packing means 42 is put in the port passage 41. The packing means 42 will be fit to the ink supply needle of the print head, liquid tightly. An air shut-off film 43, which will be broken when the ink supply needle is applied thereto, is applied and bonded to the ink supply port 35. In the figure, reference numeral 44 designates a through-hole through which the foam room 33 communicates with the ink room 34.

Figure 4A:
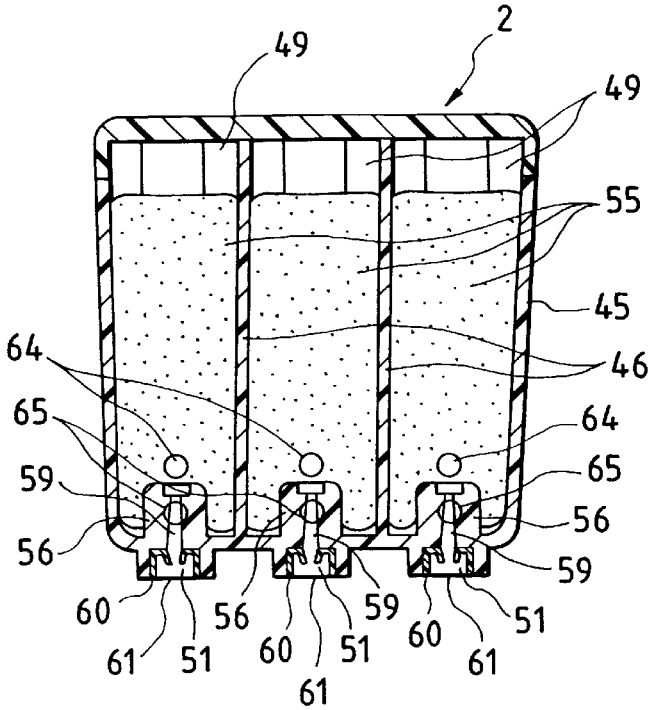
FIGS. 4(*a*) and 4(*b*) are views showing a color ink cartridge used in the ink jet printing apparatus.
Figure 4B:
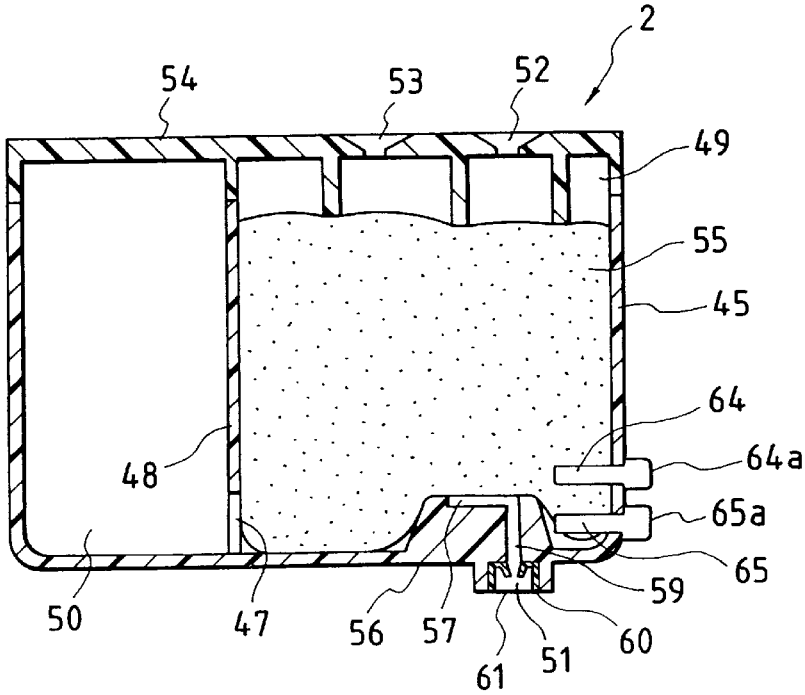

FIGS. 4(*a*) and 4(*b*) show views showing a specific example of a color ink cartridge. The structure of this ink cartridge is substantially the same as of the black ink cartridge. A container 45 with an open end is substantially cuboidal in shape, and the widthwise length of the container gradually increases toward its open end. The container 45 is divided into a plurality of rooms by walls 46. Each room is partitioned, by a partitioning wall 48, to form a foam room 49 and an ink room 50 for directly containing ink. A through-hole 47 is formed in the lower part of the partitioning wall 48.

Ink supply ports 51 that will receive ink supply needles of the color print head 7 are formed in the lower end of the foam room 49. The open end of the container 45 is sealingly closed by a cover 54 having an ink injection port 52 and an air communication port 53, which are slightly spaced from each other. The ink injection port 52 of the cover 54 is located closer to the ink supply ports of the foam room 49 when horizontally viewed.

Protruded parts 56 are formed on the bottom of the foam room 49. The protruded parts 56 cooperate with the cover 54 to compress a porous body 55. An ink inflow port 57 is formed in the upper end of each protruded part 56. A port passage 59 is extended from the ink inflow port 57 to the ink supply port 51. A packing means 60 is put in the port passage 59. The packing means 60 will be fit to the ink supply needle of the print head 7, liquid tightly. A film 61, which will be broken when the ink supply needle is applied thereto, is applied and bonded to the ink supply port 51.

In the construction of each of the ink cartridges 1 and 2, the ink cartridge is divided into the foam room and the ink room, and these rooms store ink in different ways. Any ink cartridge, if it contains at least the porous body 31 or 55 impregnated with ink, will work as the ink cartridge 1 or 2 does, in spite of the presence of the ink room 34 or 50.

In the ink cartridge thus constructed, it is necessary to check an amount of ink in the cartridge. One way to check the ink amount is to count an amount of ink consumed in the printing apparatus. In case where conductive ink is the ink to be measured in its amount, a couple of electrodes 62 and 63 (64 and 65), separated a fixed distance from each other, are located near the ink supply port to detect a liquid level of ink present in the container. These electrodes are disposed crossing the container wall in a manner that one part of each electrode is extended inward from the inner wall of the container while the other part is extended outward from the outer wall of the container. Those parts outside the container form terminals 62*a* and 63*a* (64*a* and 65*a*) to be connected to an external device.

Figure 5:
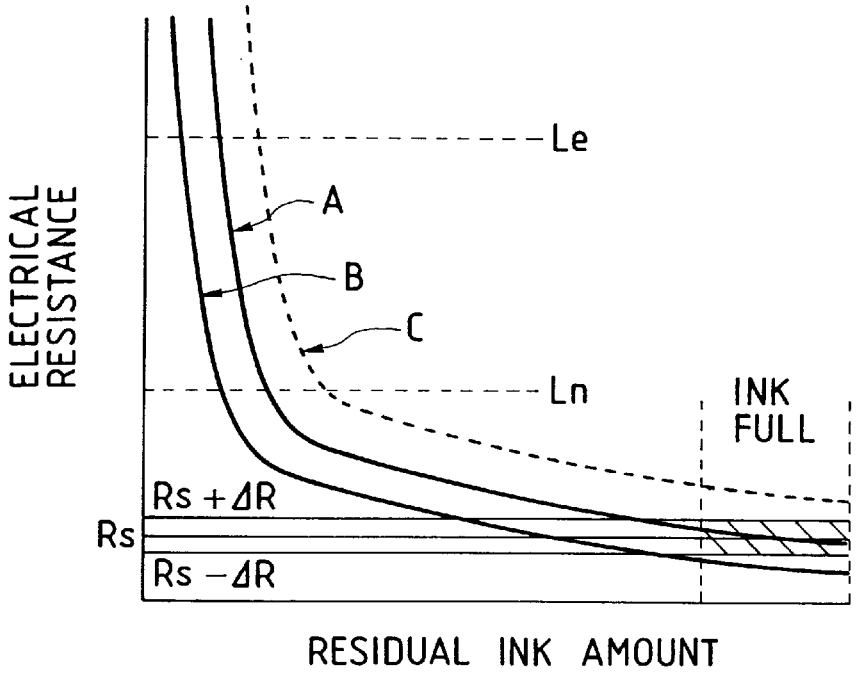
FIG. 5 is a graphical representation of a variation of an electrical resistance between paired electrodes provided in the ink cartridge with respect to an amount of residual ink.

An electrical resistance between the couple of electrodes 62 and 63 (64 and 65) varies with respect to an amount of ink remaining in the ink cartridge 1 (2) as indicated by a curve denoted as A in FIG. 5. The graph shows that the resistance value rapidly increases in a region of small quantities of residual ink. As seen from the graph, it is possible to reliably grasp a residual ink amount by presetting the following resistance values; a resistance value Ln between those electrodes 62 and 63 (64 and 65) measured in a state that a residual ink amount is such that it is very small but the print is possible, viz., a resistance value at the ink near end, and a resistance value Le between those electrodes measured in a state that the residual ink amount is such that ink is almost used up and a further print is impossible because the air bubbles are stuch in the print head 6, 7.

Figure 6:
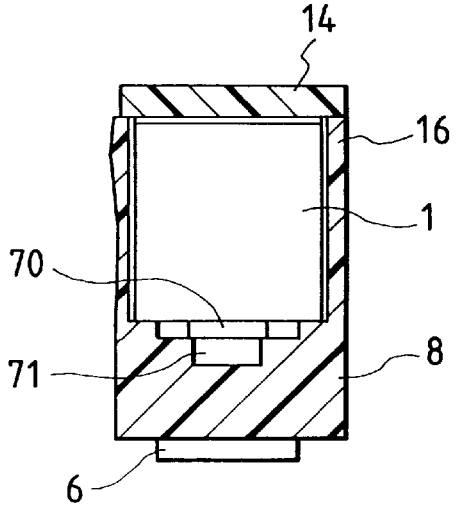
FIG. 6 is a view showing a layout of an ink characteristic data storing means and a data reading means on the ink cartridge.
Figure 7A:
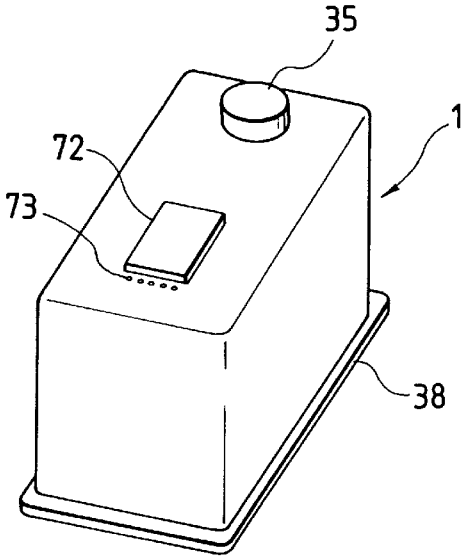
FIGS. 7(*a*) to 7(*d*) are perspective views showing some embodiments of the ink characteristic data storing means provided on a black ink cartridge.
Figure 7B:
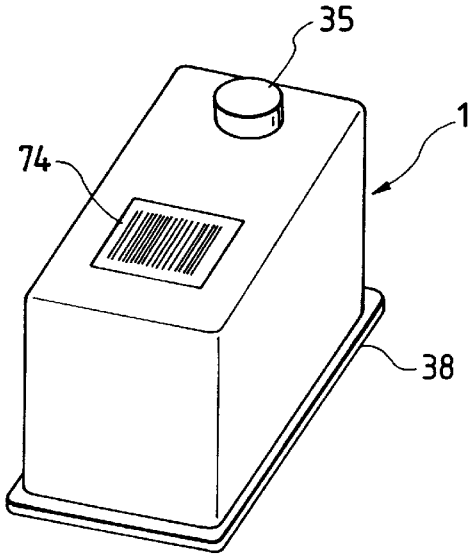
Figure 7C:
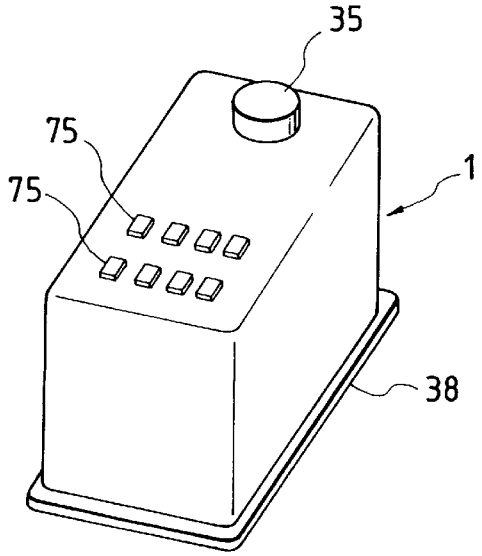
Figure 7D:
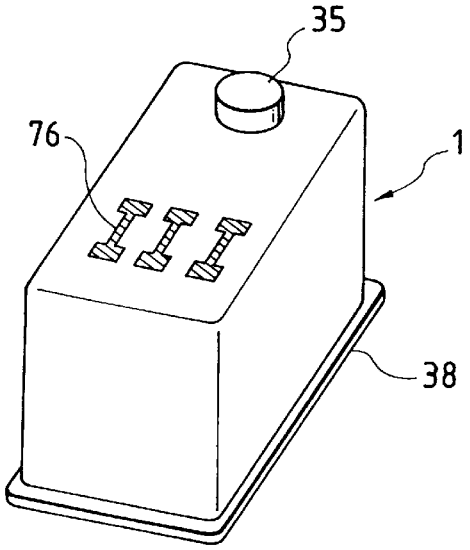

The ink cartridge thus constructed, as shown in FIG. 6, includes an ink characteristic data storing means 70 and a data reading means 71 for reading data from the ink characteristic data storing means 70. As shown, the ink characteristic data storing means 70 is attached to the surface of the ink cartridge an access to which is easy; bottom, side or upper sides of the cartridge. The data reading means 71 is firmly attached to the cartridge holder 16.

Turning now to FIGS. 7(*a*) to 7(*d*), there is illustrated some embodiments of the ink characteristic data storing means 70. In an embodiment of the ink characteristic data storing means shown in FIG. 7(*a*), an electrical storing means 72, such as a magnetic bubble storing element or a nonvolatile semiconductor storing element, is provided, and a series of contacts 73 connectable to the contact electrodes of the data reading means to making an access to the electrical storing means are disposed close to the electrical storing means. An embodiment of the storing means shown in FIG. 7(*b*) comprises a code pattern 74, for example, a bar code, formed by use of an optical ink, a magnetic ink, the like. An optical detector, a magnetic head, or the like may be used for the data reading means. An embodiment of the storing means shown in FIG. 7(*c*) comprises an array of protruded pieces 75 regularly arranged. A plurality of limit switches arranged in association with the array of the protruded pieces are used for the data reading means. These switches are selectively turned on and off. Another embodiment of the storing means is shown in FIG. 7(*d*). In this embodiment, a plurality of conductive patterns 76 are arranged to be put at predetermined positions. Contacts, which are put at the positions corresponding to those of the conductive patterns 76, form the data reading means. Data is stored in the form of presence and absence of the conductive patterns.

Such control data may be:

1) States of a drive signal to cause the print head 6 (7) used to jet an ink droplet; a drive voltage, an application time of the drive voltage, a rate of change of the voltage or current, or the like.

2) Conditions of a flushing operation: flushing period, the number of ink droplets shot forth for the flushing, continuance of flushing operation, drive voltage and its application time for causing the print head to jet an ink droplet, a rate of change of the voltage or current, or the like. The flushing operation is performed during the printing period to prevent the clogging of the nozzle orifices. In the operation, the printing operation is stopped and the print head is moved to the ink receptacles, and ink droplets are purged from the nozzle orifices into the receptacles, irrespective of the print data.

3) Conditions of the sucking operation: a sucking pressure of the sucking pump, sucking rate, operation time, an amount of suction, and the like. The sucking operation is performed, for example, when the ink cartridge is replaced with a new one. In the operation, a negative pressure is applied to the nozzle orifices to purge ink therefrom.

4) In the case of the regenerated cartridge, the number of uses of the cartridge.

Figure 8:
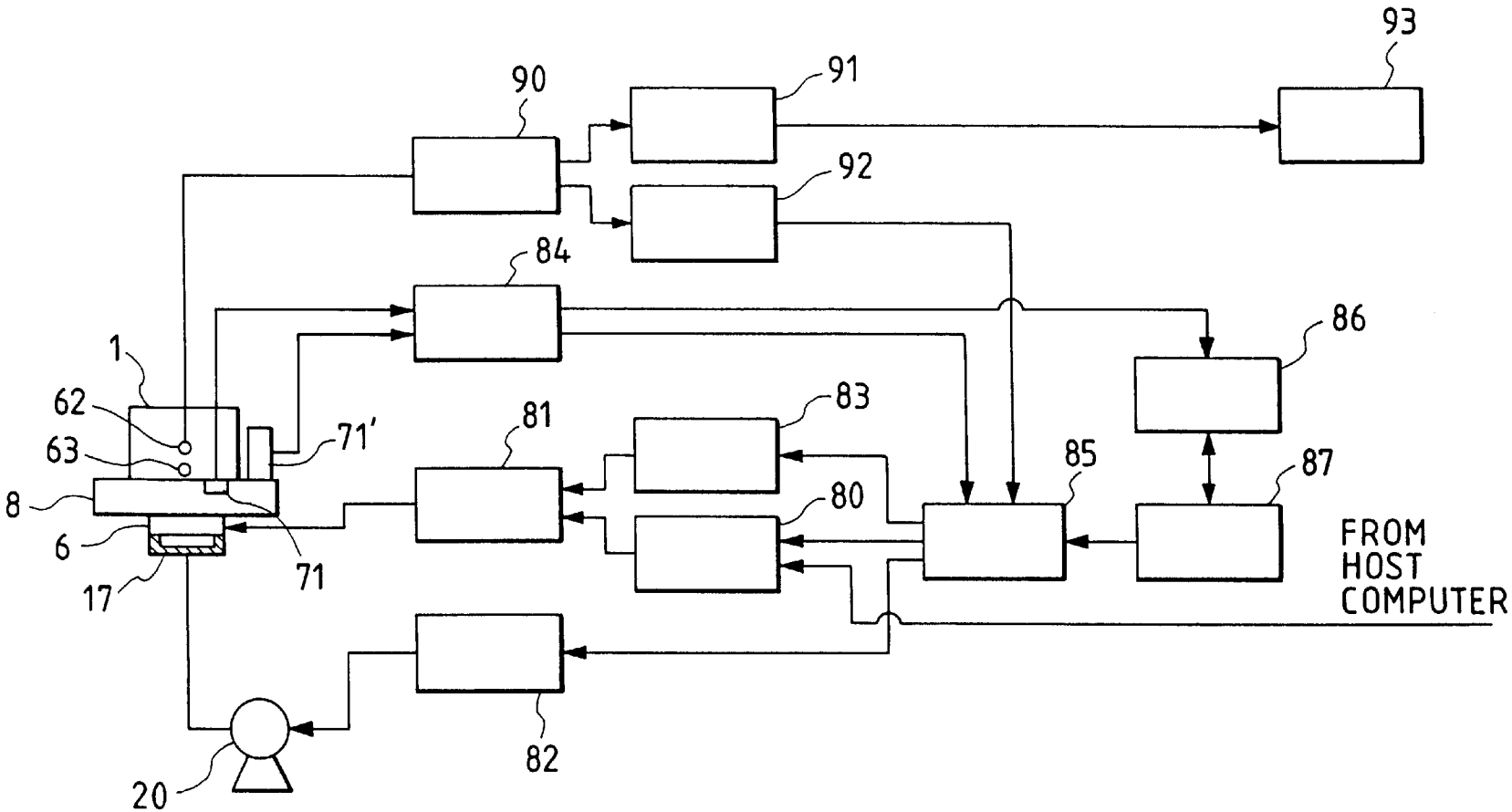
FIG. 8 is a block diagram showing a control unit for carrying out various controls in accordance with the nature of ink by use of the ink cartridge.

FIG. 8 is a block diagram showing a control unit for carrying out various controls in accordance with the nature of ink by use of the thus constructed ink cartridge. The black ink cartridge 1 is used in this embodiment. Substantially the same control unit is available for the color ink cartridges, as a matter of course.

In the figure, reference numeral 80 is a print control means which controls the carriage drive motor 10 in accordance with print data received from a host computer which causes a head drive means 81 to output a drive signal to drive the black print head 6. Numeral 82 is a suction control means for controlling a sucking time and a sucking force. When the black ink cartridge 1 is replaced with another cartridge or the black print head 6 is clogged, the suction control means 82 is used. In this case, the black print head 6 is sealed with the capping members 17, and a negative pressure is applied to the sealed black print head 6. Numeral 83 is a flushing control means having a function to control a period at which a flushing operation is performed, and a time for which the flushing operation continues, and another function to output a drive signal to the head drive means 81 to start the flushing operation. The flushing operation is executed, during a print period, to prevent the black print head 6 from being clogged with ink of an increased viscosity. In the flushing operation, the printing operation is stopped for a given period and the black print head 6 is driven to discharge ink droplets irrespective of print data. The print control means 80, head drive means 81, suction control means 82, and flushing control means 83 are essential in executing the minimum functions required for the ink jet printing apparatus.

Numeral 84 is a data read-out means. The data read-out means 84 responds to a signal output from the data reading means 71 and 71' attached to the carriage 8, for example, and reads data from the ink characteristic data storing means 70 of the black ink cartridge 1 and outputs the read out data to a control data read-out means 85 and a control data writing means 86, which will be described later.

The control data read-out means 85, referred to just above, refers to a control data storing means 87 to be given later and selects an optimum print condition from the contents stored in the storing means in accordance with the ink nature, for example, of the black ink cartridge 1, and transfers the selected one to the print control means 80, suction control means 82 and flushing control means 83. The control data writing means 86 updates data stored in the control data storing means 87 when the data read-out means 84 outputs data to request the version up of the printing apparatus.

The control data storing means 87 is a nonvolatile semiconductor storing means, e.g., flash memory, which is easily electrically reprogammable and capable of holding data without being destroyed when no electric power is supplied to the printing apparatus. The control data storing means 87 stores data of the factors determining the characteristic of a drive signal, which are adjusted in connection with ink in the black ink cartridge 1 attached to the printing apparatus. Examples of the factors are: voltage, application time, a rate of changing of voltage and current, period at which the flushing operation is performed, continuance of the flushing operation in time, time duration of a sucking operation, and sucking force.

Numeral 90 designates a resistance detecting means for detecting an electrical resistance value between the electrodes 62 and 63 of the ink cartridge for the purpose of ink end detection. A detection result is applied to an ink amount detecting means 91 and an ink nature detecting means 92. When an electrical resistance value between the electrodes 62 and 63 increases to reach a reference value Ln (see FIG. 5), the ink amount detecting means 91 causes a display 93 to display an ink near end message directing a user to replace the ink cartridge with a new one. When the resistance value reaches another reference value Le, the ink amount detecting means 91 causes the display 93 to display an ink end or, if necessary, outputs a signal to stop the printing operation.

The ink nature detecting means 92, just referred to above, judges whether or not ink filling the black ink cartridge 1 is suitable for black print head 6 depending on an electric conductivity of ink that can be known from an electrode-to-electrode resistance in the ink full state of the black ink cartridge 1. The result of the judgement is applied to the control data read-out means 85.

An operation of the thus arranged control unit of the ink jet printing apparatus will be described.

Upon power on, the print control means 80 reads control data from the control data storing means 87, and waits for input print data. In this state, print data is input to the control unit. Then, the print control means 80 causes the head drive means 81 to output a drive signal to form dots defined by the print data under control of control data output from the control data storing means 87.

A size of a dot formed on a print sheet with an ink droplet discharged from the black print head 6 depends on a viscosity of ink and a permeability of ink into the print sheet. For this reason, in printing dots, a drive energy is used which is suitable for the characteristic of the ink contained in the black ink cartridge 1 now loaded, whereby an amount of an ink droplet is optimumly adjusted to keep a print quality at the highest level. The amount of the ink droplet may readily be reset by controlling a voltage and application time of the drive signal, changing rates of the voltage and current in accordance with data from the control data storing means 87.

A printing operation continues for a give time, and a clogging occurrence time, which depends on an evaporation characteristic of ink of the black ink cartridge 1, elapses. Then, the print control means 80 moves the carriage 8 to a nonprint region and causes the black print head 6 to face an ink receptacle, for example, the capping members 17. And it drives the black print head 6 to discharge a fixed number of ink droplets. As the result of the discharging operation, ink whose viscosity was increased in the black print head 6 is discharged into the capping members 17. Then, ink suitable for the print is discharged from the black ink cartridge 1, and the printing operation will continue while keeping a fixed print quality level.

When the printing operation continues for a long period and ink is used up in the black ink cartridge 1, the old black ink cartridge 1 is detached from the cartridge holder 16 and a new black ink cartridge 1 is attached to the holder. The detaching and attaching of the black ink cartridge 1 is detected by the data reading means 71. Then, the data read-out means 84 reads ink characteristic data on the new black ink cartridge 1 from the ink characteristic data storing means 70.

When the ink of the new black ink cartridge 1 is improved and requires an alteration of the control conditions, the control data writing means 86 updates data in the control data storing means 87 in accordance with the data on the black ink cartridge 1 that is stored in the ink characteristic data storing means 70.

When the replacement of the black ink cartridge 1 ends, the suction control means 82 moves the carriage 8 to the capping position, and seals the black print head 6 with the capping members 17. Then, it controls a suction force and a suction time of the pump unit 20 on the basis of the updated suction control data stored in the control data storing means 87, causes the print head to discharge ink at the suction pressure and time suitable for the ink viscosity of the black ink cartridge 1 attached. In this case, air bubbles that entered, together with ink, into the black print head 6 are also discharged, to thereby preventing a print defect.

When such a maintenance operation ends and a printing operation starts again, the print control means 80 reads the updated control data from the control data storing means 87, and causes the head drive means 81 to output a drive signal suitable for the ink characteristic, for example, viscosity, in the replaced black ink cartridge 1. In this way, the printing operation is performed in the best condition without requiring a user's adjustment although the ink characteristic has been changed.

When the printing operation continues for a preset time and it reaches a flushing period determined by the ink characteristic of ink in the black ink cartridge 1, the flushing control means 83 move the carriage 8 to the nonprint region, and directs the black print head 6 to the ink receptacles, for example, capping members 17. Thus, the printing apparatus can continue the printing operation while keeping a required print quality, although the ink characteristic has been changed.

In such a case where the printer is not used for a long time and the print head 6 may be clogged, a cleaning button 95 on a control panel 94 of the case is pushed or a timer contained in the machine issues a cleaning signal. In turn, the suction control means 82 moves the carriage 8 to the capping position, and seals the print head 6 with the capping members 17 in preparation for a forcible charging of ink. The suction control means controls a suction force and a suction time of the pump unit 20 on the basis of the suction control data of the control data storing means 87 to purge ink in a condition suitable for the loaded ink cartridge 1. As a result, ink whose viscosity is extremely increased is forcibly discharged and the clogging of the print head is removed.

When a black ink cartridge 1 filled with ink improved in its characteristic for print quality improvements is delivered from a manufacturer without any announcement on the characteristic improvement, the printing apparatus of the invention accepts such an ink cartridge since control data may be automatically updated before the black print head 6 is driven or the maintenance condition may be altered. In other words, if control data suitable for ink is stored in the ink characteristic data storing means 70 of the ink cartridge 1, the manufacturer can change the specifications of ink as desired. The manufacturer can provide more varied products.

If a memory of a relatively large memory capacity, such as a semiconductor storing means, is used for the ink characteristic data storing means 70, catch phrases, logotypes and the like that may legally be registered as a copyright may be stored in the form of protected data in the storing means. In this case, the data read-out means 84 is given an additional function to allow the printing only when the data read-out means 84 confirms the protected data in a coincidence manner. By so designed, an unwanted situation is unlikely to arise where an excessive amount of incorrect ink, which is supplied not through regular sales channels, is mistakenly injected into the print head. The result is to minimize the damage of the print head and the loss of the user.

The ink cartridge having the electrodes 62 and 63 for detecting an ink end in the ink cartridge 1 is in an ink full state immediately after replacement of the ink cartridge 1. Therefore, a resistance value between the electrodes 62 and 63 is not dependent on an amount of ink left in the ink cartridge, but dependent only on a conductivity of ink (in the ink full region in FIG. 5). Therefore, in this state a conductivity of ink can be measured.

When the ink cartridge 1 is replaced with another cartridge, the ink nature detecting means 92 measures a conductivity of ink in the ink cartridge 1 by use of a signal from the resistance detecting means 90. The means 92 compares the measured one with the reference value Rs produced between the electrodes for a conductivity of ink suitable for the black print head 6 (hatched range in FIG. 5). When the measured resistance value falls within a preset range Rs±ΔR, the ink nature detecting means judges that the ink used is suitable for the print head, and executes the subsequent process.

When it is out of the preset range Rs+ΔR, (inks exhibiting resistance characteristics denoted as B and C), specific control data for a protection operation is stored in advance into the control data storing means 87, and the control conditions of the suction control means 82 and the flushing control means 83, both for maintenance, are altered.

To be more specific, for the forcible discharging of ink, the suction time is set to be somewhat long, whereby an ink exchanging rate of the black print head 6 is increased. The flushing period during the printing operation is set to be short, whereby the flushing is performed frequently. One flushing time is set to be long, whereby the amount of ink to be discharged is increased. Where the ink discharging amount is increased, the print quality is little deteriorated even if the ink tending to clog the print head 6 is used. The ink that may damage the print head 6 is quickly consumed, the replacing period of the ink cartridge 1 is reduced, and consequently the damage of the print head is minimized.

Figure 9:
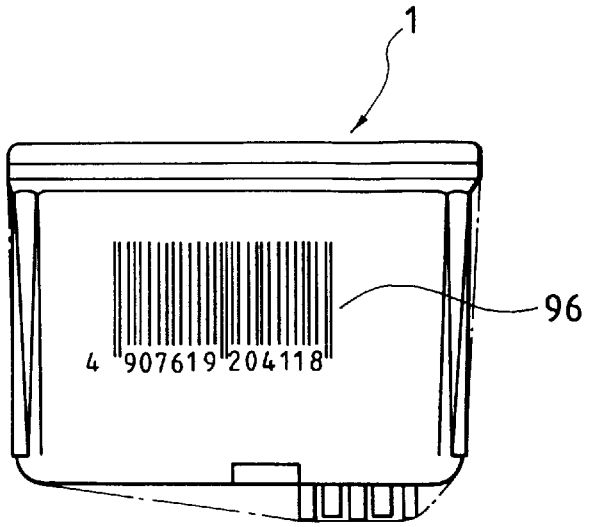
FIG. 9 is a view showing an ink cartridge.

In the case of the ink cartridge after ink contained therein is completely used up, the container of the cartridge experiences only its attaching and detaching to and from the print head 6, and there is a less chance of being damaged. Therefore, such a cartridge can be used again if some parts, for example, packing and sealing pieces, are replaced with new ones. As shown in FIG. 9, an indication 96 indicative of a lot number, usually a bar code, is printed on a preset location of the ink cartridge 1. The lot number may be used to specify a type of the printing apparatus or the print head suitable for the ink cartridge, composition of ink, and a factory to manufacture the ink cartridge with the lot number.

Figure 10:
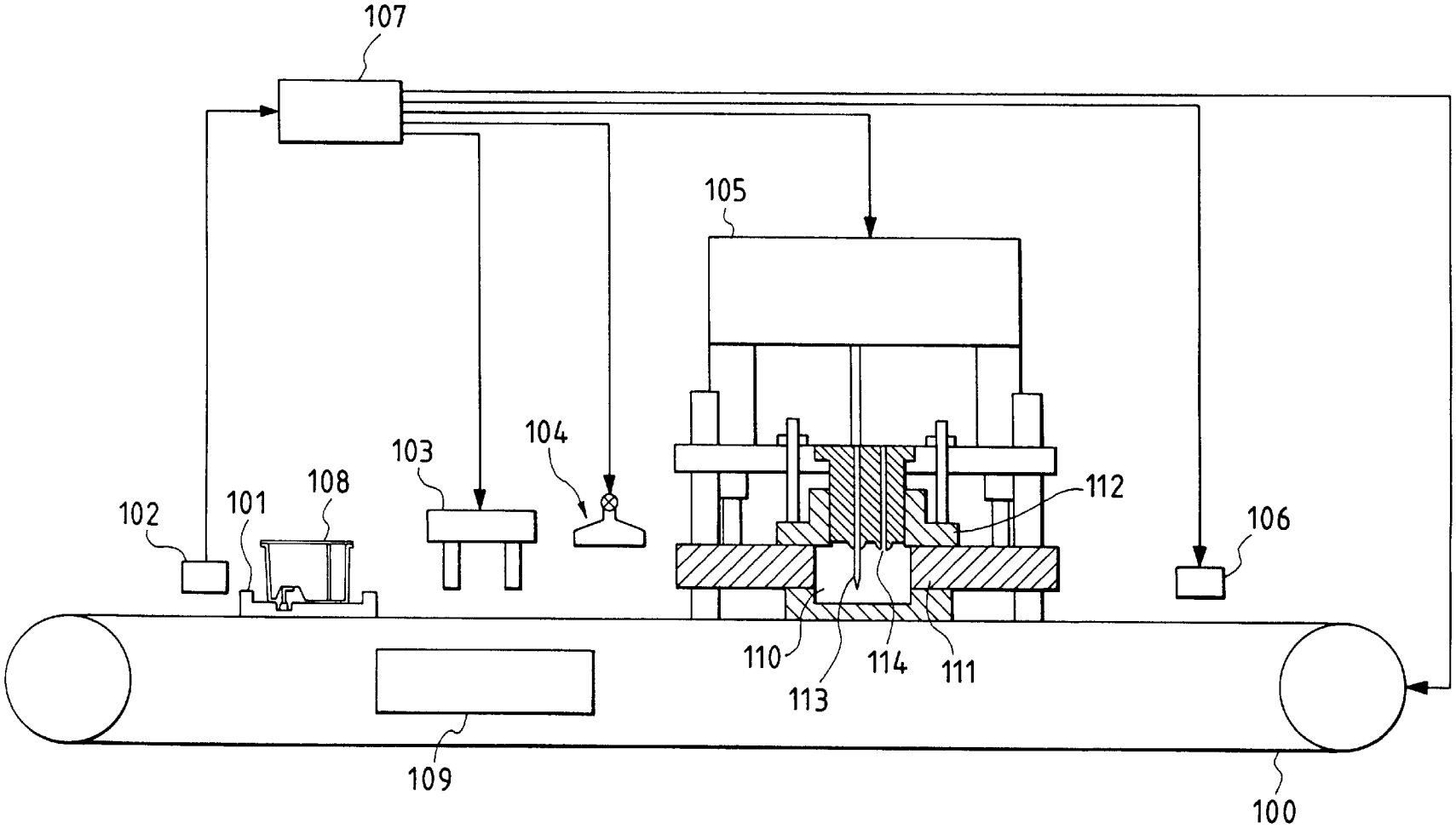
FIG. 10 is a diagram showing a cartridge regeneration equipment used for regenerating such used ink cartridges.
Figure 11A:
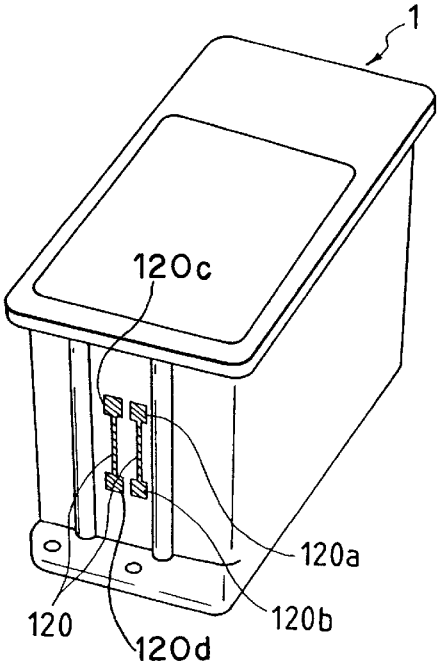
FIGS. 11(*a*) and 11(*b*) are views showing embodiments of used ink cartridges, and FIGS. 11(*c*) and 11(*d*) are views showing conductive patterns on the ink cartridges after those are used one time and two times.
Figure 11B:
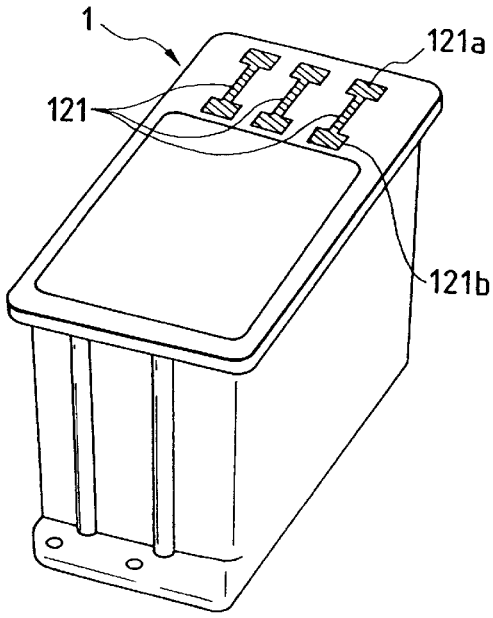
Figure 11C:
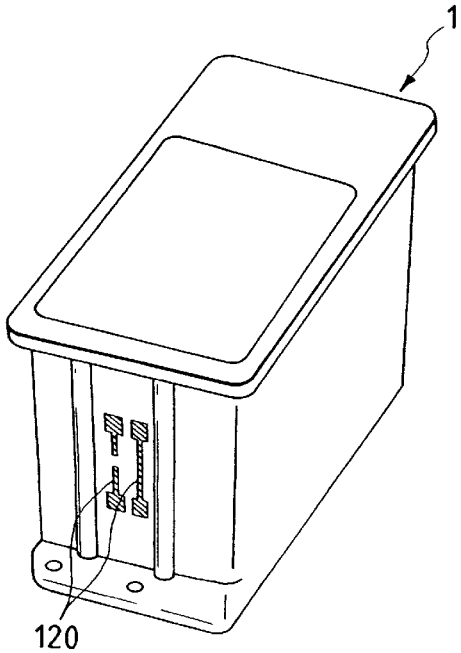
Figure 11D:
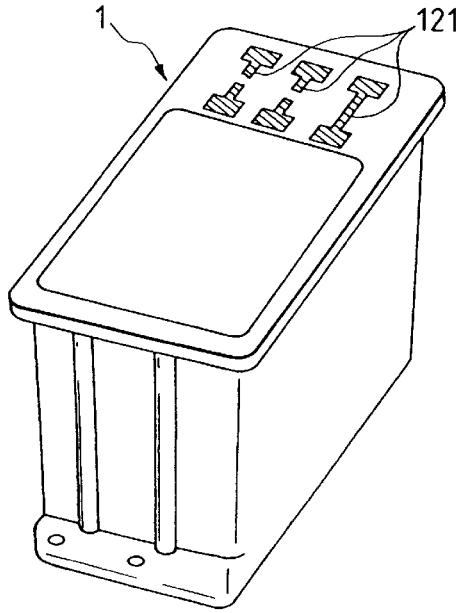
Figure 12:
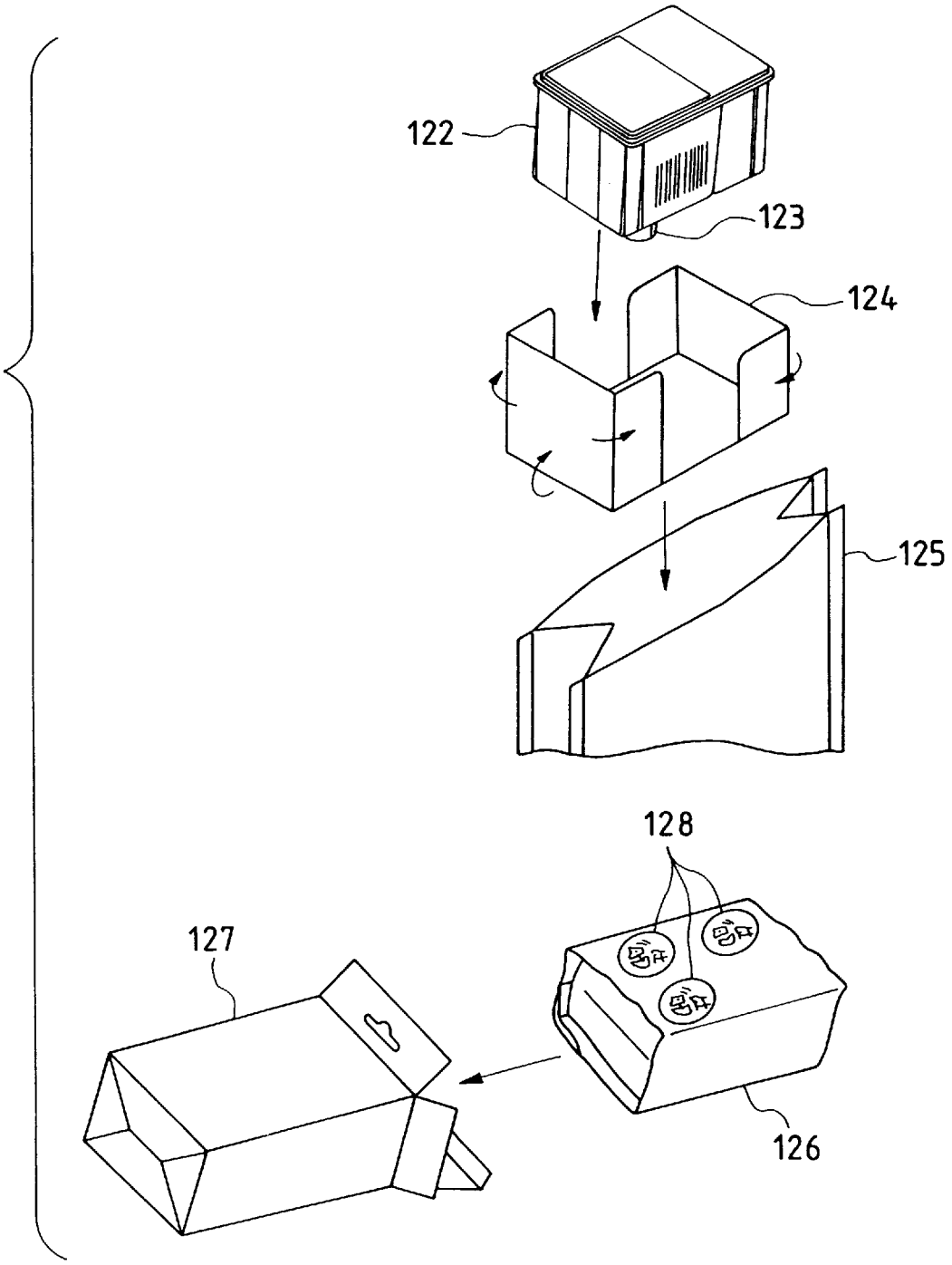
FIG. 12 is a view showing a process of packing the used ink cartridge.

FIG. 10 shows an example of a cartridge regeneration equipment used for regenerating such used ink cartridges. A conveying means designated by reference numeral 100, for example, a belt conveyor, conveys a pallet 101 capable of holding an ink cartridge 108 in a fixed posture along a lot number reading means 102, removal means 103, washing means 104, ink filler 105, and data writing means 106 arranged in this order.

A regenerating process controller 107 judges the number of uses of the ink cartridge 108 by use of data read out of the bar codes on the ink cartridge. When the ink cartridge is used five times or larger, the regenerating process controller produces a signal for transmission to the removal means 103 to cause it to discard the ink cartridge. Thus, only the ink cartridge that is used a few times is washed with the washing means 104, and then is conveyed to the ink filler 105. The ink filler removes ink still left in the ink cartridge, and fills the ink cartridge with new ink. After the refilling, the data writing means 106 prints data indicative of reuse, for example, data specifying the number of uses of the ink cartridge.

The ink filler 105 includes a chamber body 111 forming an injection/discharge chamber 110 that may be opened and closed, and a cover member 112 that may also be opened and closed. The cover member 112 is provided with an ink suction/injection needle 113 to be inserted into the ink injection port 36 of the ink cartridge, and an exhaust pipe 114 communicatively connected to the air communication port 37. The ink suction/injection needle 113 is connected to a suction means by way of a passage switch valve (not shown), and a fixed-amount ink supplying means. The injection/discharge chamber 110 is connected to a vacuum pump (not shown).

In the ink filler thus constructed, the ink cartridge 108 is put in the injection/discharge chamber 110, and the injection/discharge chamber 110 is sealed with the cover member 112. As a result, the ink suction/injection needle 113 is inserted into the ink injection port 36 of the ink cartridge 108, and the residual ink is purged out by the suction means. A pressure in the injection/discharge chamber 110 is reduced by the vacuum pump, and the passage switch valve is turned to the fixed amount ink supplying means which in turn supplies ink to the ink cartridge 108. Thus, the ink injection is carried out under a reduced pressure condition. Therefore, a long life of product quality is guaranteed.

Upon completion of the filling of ink, a total number of uses of the ink cartridge 1 is stored in the ink characteristic data storing means 70 thereof or a storing means exclusively used for that data storage. Here, the ink filler completes its ink filling operation. The total number of uses of the ink cartridge is preferably stored in the form of patterns that are impossible to alter, modify and change and easy to see. Embodiments of such patterns are illustrated in FIGS. 11(*a*) and 11(*b*). The patterns illustrated are conductive patterns 120 and 121 that may be cut, and the number of conductive patterns corresponding to the total number of uses of the ink cartridge are formed on an easy-to-see location on the ink cartridge by printing, for example. The conductive patterns 120 and 121 are cut as visually and clearly recognized, corresponding to the number of regenerations of the ink cartridge as shown in FIGS. 11(*c*) and 11(*d*).

Contact electrodes are formed at locations coincident with contact portions 120*a*, 120*b*, 120*c*, 120*d* of the conductive patterns 120 and 121 when the ink cartridge 1 is set to the cartridge holder 16 or the lever 14 or 15 of the cartridge holder 16. Data on those patterns are read out by the data read-out means 84, and used for altering the control conditions by the control data read-out means 85. Specifically, for the forcible discharging of ink, the suction time is set to be somewhat long, whereby an ink exchanging rate of the black print head 6 is increased. The flushing period during the printing operation is set to be short, whereby the flushing is performed frequently. One flushing time is set to be long, whereby the amount of ink to be discharged is increased. Where the ink discharging amount is increased, the print quality is little deteriorated if a reliability of the ink cartridge is reduced as result of the reusing of the cartridge.

The ink cartridge 122 thus refilled with ink is packed, for securing its good storage, such that at least the ink supply port 123 thereof is covered with a damper member 124, and put into an air shut-off bag 125 and a pressure within the bag is reduced. The ink cartridge 126, sealingly put in the air shut-off bag 125, is packed into a box 127, and then the box contained ink cartridge is delivered to a market.

Seals 128 indicating a regenerated or disposal product are printed on the bag containing the ink cartridge. In this case, some means, such as the number of seals, color or design, which is capable of clearly showing the number of reuses of the cartridge is preferably formed on the box 127. If so done, a mutual reliance between the manufacturer and the user will be enhanced.

Figure 13:
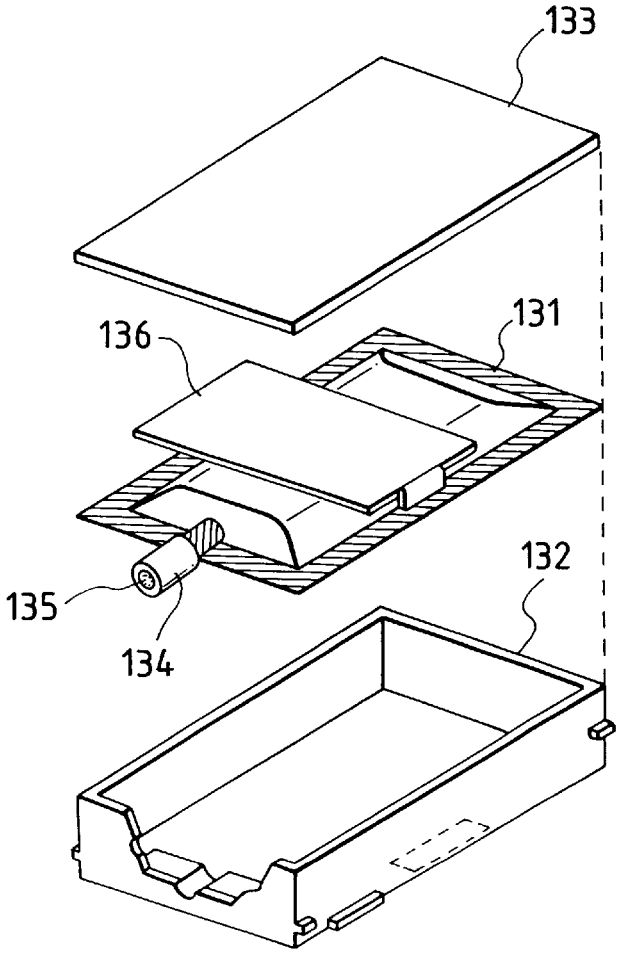
FIG. 13 is a view showing another ink cartridge to which the present invention is applicable.

While in the above-mentioned embodiment, the ink cartridge is mounted on the carriage, the present invention may be applied to the ink cartridge of the type in which the cartridge is mounted on a case and supplies ink to the print head by way of an ink tube. An embodiment where the present invention is embodied in such type of the ink cartridge is shown in FIG. 13. The ink cartridge in this embodiment is made up of a flat ink bag 131 for sealingly containing ink therein, a hard case 132 for receiving the ink bag, and a cover 133.

The flat ink bag 131 follows. For securing a gas barrier function, an aluminum foil is sandwiched with two films into an aluminum laminated film. Of those films, the outside film is a nylon film, for example, and the inside film is a polyethylene film, for example. Two aluminum laminated films are layered one on the other. Three sides of the resultant film are bonded together by heat welding, and an ink supply port 134 of a plastic molded product is attached to the remaining side thereof. The ink supply port 134 is sealed with a septum 135 made of an elastic material, e.g., rubber, which receives an ink supply needle attached to the extremity of the ink jet printing apparatus. In the figure, numeral 136 is a detecting plate for detecting an amount of ink in the ink bag 131.

Figure 14:
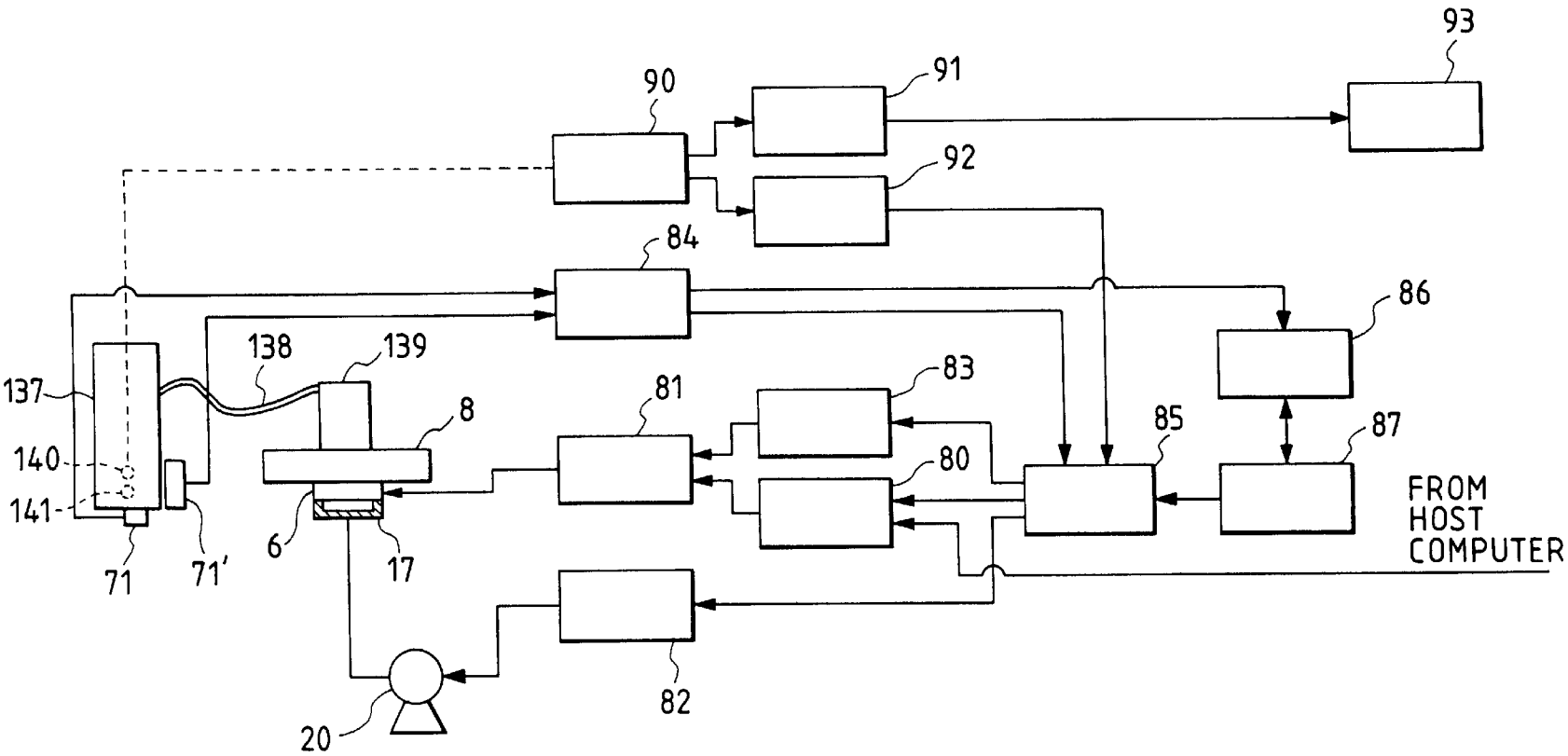
FIG. 14 is a diagram showing a control unit of an ink jet printing apparatus using the ink cartridge of FIG. 12.

As shown in FIG. 14, the ink cartridge 137 is mounted on the case, and communicatively connected through an ink tube 138 to a subtank 139. The subtank 139 supplies ink to the black print head 6.

The ink characteristic data storing means 70 is provided on the hard case 132 or the cover 133 of the ink cartridge 137. The data reading means 71 is mounted on the case. The control conditions may automatically be altered in accordance with ink characteristics and the number of reuses of the ink cartridge by use of the control unit as already stated. The thus constructed ink cartridge 137, usually, detects an amount of residual ink on the basis of a displacement of the detecting plate 136. Alternatively, electrodes 140 and 141 are attached to the flat ink bag 131. In this case, ink nature is detected by use of a conductivity of ink, and the maintenance conditions are altered as in the above-mentioned manner. When the ink cartridge 137 is reused, the residual ink may be purged from the ink cartridge, and new ink is injected into the ink cartridge as in the above-mentioned case, by use of an ink injection/discharge needle, if it is put to the septum 135.

In the embodiments described above, description is made on the case where specification for ink is altered and the ink cartridge is processed for reuse by the manufacturer. A modification is allowed where an optimum control condition that is set in the printing apparatus is stored into the ink characteristic data storing means 70 of the ink cartridge. Where a plural number of print media whose ink absorbing characteristics are greatly different are used for print, the control conditions best for the print media may automatically be set up in the ink jet printing apparatus by merely exchanging the ink cartridge with a suitable one.

As seen from the foregoing description, the control conditions for the ink jet printing apparatus can be altered, without any aid of users, in compliance with the characteristic of ink in the ink cartridge and a reliability variation ensuing from the reuse of the ink cartridge. Therefore, the operation mode of the ink jet printing apparatus may be altered in accordance with the composition of ink, which will greatly influences the print quality and the maintenance condition. When the used ink cartridge is used, the maintenance condition may automatically be altered in accordance with the number of the reuses of the ink cartridge. Therefore, a satisfactory print quality is secured, the reuse of the ink cartridge is possible, and the ink cartridge that may contaminate environment may be collected.

What is claimed is:

1. An ink jet printing apparatus comprising:

an ink jet print head mounted on a carriage reciprocally movable relative to a print medium;

an ink cartridge for supplying ink to said ink jet print head;

print control means for outputting a drive signal to said ink jet print head in accordance with print data;

head maintenance control means for discharging ink not contributing to print so as to secure a normal ink discharge from said ink jet print head;

control data storing means for storing data representative of functional criteria for controlling said print control means and said head maintenance control means; and data storing means for storing data representative of the functional criteria for controlling at least one of said print control means and said head maintenance control means based on a nature of ink, and being disposed on said ink cartridge;

data reading means on said carriage for reading the data stored in a cartridge to set data representative of functional criteria in said control data storing means to correspond to the data stored in said storing means on said cartridge;

where in a control mode of either of said print control means and said head maintenance control means may be altered by the data representative of the functional criteria.

2. The ink jet printing apparatus according to claim 1, wherein said head maintenance control means includes flushing control means for outputting a drive signal to said ink jet print head to cause said ink jet print head to discharge ink droplets in order to prevent said ink jet print head from being clogged, and suction control means for sealing said ink jet print head with a capping member and causing sucking means to apply a negative pressure to said ink jet print head thereby sucking ink from said ink jet print head.

3. The ink jet printing apparatus according to claim 2, wherein the data representative of functional criteria is any one or more of data on voltage, pulse width, and voltage slope of a drive signal, flushing period, continuance of flushing operation in time, suction pressure, suction rate, and suction duration of sucking operation, and the number of reuses of said ink cartridge.

4. The ink jet printing apparatus according to claim 1, wherein said control data storing means comprises electrically reprogrammable storing means, and further comprises control data writing means for updating the control data in said control data storing means in accordance with the data representative of functional criteria.

5. The ink jet printing apparatus according to claim 1, further comprising an ink nature detecting means for detecting an electrical characteristic of ink in said ink cartridge operation ally coupled to s aid head maintenance control means, when an ink cartridge containing ink whose detected electrical characteristic is different from a reference value, said head maintenance control means setting an amount of ink to be discharged by the print head to an ink amount in excess of the amount of ink to be discharged when the detected electrical characteristic of an ink cartridge is equal to a reference value.

6. The ink jet printing apparatus according to claim 1, wherein when the data representative of functional criteria indicates that the ink cartridge is a used ink cartridge, said head maintenance control means sets an amount of ink to be discharged from the print head to an ink amount in excess of the amount of ink discharged when the ink cartridge is new.

7. The ink jet printing apparatus according to claim 1, wherein said ink cartridge is removably mounted on the carriage.

8. The ink jet printing apparatus according to claim 1, wherein said ink cartridge is removably put in a case, and supplies ink jet print head by means of an ink tube.

9. An ink cartridge comprising:

an ink cartridge having an ink supply port connectable to an ink jet print head of a printer having a print control means for outputting a drive signal to said ink jet print head in accordance with print data and a head maintenance means for discharging ink not contributing to print so as to secure a normal ink discharge from said ink jet print head, said ink cartridge containing ink; and data storing means for storing data representative of specific functional criteria for controlling at least one of said print control means and said head maintenance means of said printer for specifying the nature of said ink, said data storing means being disposed on said ink cartridge;

wherein said data storing means is located at a position on said ink cartridge where said data in said data storing means can be read from outside, when said ink cartridge is set in a holder of said printer.

10. The ink cartridge according to claim 9, wherein said data representative of specific functional criteria is any one or more of data on voltage, pulse width, and voltage slope of a drive signal for the ink jet print head in accordance with print data, period of a flushing operation to cause the ink jet print head to discharge ink droplets in order to prevent the ink jet print head from being clogged, continuance of flushing operation in time, suction pressure, suction rate, and suction duration of sucking operation for sealing the ink jet print head with a capping member and causing sucking means to apply a negative pressure to the ink jet print head to thereby discharge ink therefrom, and the number of reuses of said ink cartridge.

11. The ink cartridge according to claim 10, wherein the data representing the number of reuses of said ink cartridge comprises patterns that cannot be rewritten.

12. The ink cartridge according to claim 10, wherein the data from which the number of reuses of said ink cartridge is read is provided on a surface of said ink cartridge and can be visually read.

13. The ink cartridge according to claim 9, wherein said data storing means comprises any one of an electronic storage element, conductive patterns, optical patterns, mechanical patterns, and magnetic patterns.

14. The ink cartridge according to claim 9, further comprising electrodes for determining the nature of ink and being located at positions where an external electrical access thereto is allowed.

15. The ink cartridge according to claim 14, in which said electrodes also serve as means for detecting an amount of residual ink.

16. The ink cartridge according to claim 9, wherein said ink cartridge includes an ink injection port through which said ink cartridge can be refilled with ink.

17. The ink cartridge according to claim 9, wherein said ink cartridge is removably mountable on a carriage of a printing apparatus.

18. An ink jet printing apparatus comprising:

an ink jet print head mounted on a carriage reciprocally movable relative to a print medium;

an ink cartridge for supplying ink to said ink jet print head;

print control means for outputting a drive signal to said ink jet print head in accordance with print data;

head maintenance control means for discharging ink not contributing to print so as to secure a normal ink discharge from said ink jet print head;

control data storing means for storing control data for said print control means and said head maintenance control means; and ink cartridge data storing means for storing ink characteristic data based on a nature of ink, and being disposed on said ink cartridge;

wherein a control mode of one or both of said print control means and said head maintenance control means may be altered by the ink characteristic data, when the ink characteristic data indicates that the ink cartridge is a used ink cartridge, said head maintenance control means setting an amount of ink to be discharged from the ink jet print head to an ink amount in excess of the ink to be discharged when the ink cartridge is new.

19. An ink cartridge comprising:

an ink container having an ink supply port connectable to a print head and containing ink; and ink characteristic data storing means for storing data for specifying a nature of the ink, and being disposed on said ink cartridge;

a control means on an ink jet printer main body being controlled according to control data stored on said ink cartridge; and electrodes for determining the nature of ink and being located at positions on said ink cartridge where an external electrical access thereto is allowed, said electrodes also serving as means for detecting an amount or residual ink;

wherein said ink characteristic data storing means is located at a position where said ink characteristic data storing means can be read from outside, when said ink cartridge is set in a holder of a printer.

20. An ink jet printing apparatus comprising:

an ink jet print head mounted on a carriage reciprocally movable relative to a print medium;

an ink cartridge for supplying ink to said ink jet print head removably mounted on a part of the ink jet printing apparatus;

means for controlling ejection of the ink by said ink jet print head;

control data storing means for storing data representative of functional criteria for controlling the ejection of the ink;

data storing means for storing data representative of the functional criteria for controlling the ejection of the ink based on a nature of ink, and being disposed on said ink cartridge; and data reading means for reading the data stored in an ink cartridge mounted on said carriage to set data representative of functional criteria in said control data storing means to correspond to the data stored in said data storing means on said ink cartridge;

wherein a control mode of said means for controlling ejection of the ink may be altered by the data representative of the functional criteria.

21. The ink jet printing apparatus according to claim 20, wherein said means for controlling ejection of the ink includes:

print control means for outputting a drive signal to said ink jet print head in accordance with print data; and head maintenance control means for discharging ink not contributing to print so as to secure a normal ink discharge from said ink jet print head.

22. An ink cartridge comprising:

an ink cartridge having an ink supply port releasably connectable directly or indirectly to a print head of a printer having means for controlling ejection of ink by said print head, said ink cartridge containing the ink; and data storing means for storing data representative of specific functional criteria for controlling the ejection of the ink for specifying the nature of said ink, said data storing means being disposed on said ink cartridge;

wherein said data storing means is located at a position on said ink cartridge where said data in said data storing means can be read from outside, when said ink cartridge is set in a holder of said printer.

* * * * *